United States Patent [19]

Ko

[11] Patent Number: 4,808,784

[45] Date of Patent: Feb. 28, 1989

[54] HIGH FREQUENCY DISPERSING DEVICE IN A MICROWAVE OVEN

[75] Inventor: Heungchan Ko, Kyungkido, Rep. of Korea

[73] Assignee: Sam Sung Electronic Co., Ltd., Kyungkido, Rep. of Korea

[21] Appl. No.: 140,788

[22] Filed: Jan. 5, 1988

[30] Foreign Application Priority Data

Mar. 14, 1987 [KR] Rep. of Korea ..... 2361/87

[51] Int. Cl.[4] ..... H05B 6/72

[52] U.S. Cl. ..... 219/10.55 F; 219/10.55 E

[58] Field of Search ..... 219/10.55 F, 10.55 E, 219/10.55 R

[56] References Cited

U.S. PATENT DOCUMENTS 3,210,511 10/1965 Smith ..... 219/10.55 F
3,641,301 2/1972 Ikeda ..... 219/10.55 F
4,223,194 9/1980 Fitzmayer ..... 219/10.55 F
4,329,557 5/1982 Staats ..... 219/10.55 F
4,335,289 6/1982 Smith ..... 219/10.55 F

*Primary Examiner*—Philip H. Leung
*Attorney, Agent, or Firm*—Antonelli, Terry & Wands

[57] ABSTRACT

A specially designed waveguide is disposed in a microwave oven for evenly dispersing high frequency energy to the heating chamber of the oven. The waveguide is formed by an upper plate and base plate disposed above the heating chamber. The base plate includes a magnetron at an end portion thereof and various openings for dispersing the high frequency energy output by a magnetron antenna uniformly into the heating chamber. The upper plate covers the base plate and includes a stub and a conically shaped protrusion for reflecting and guiding the high frequency energy output from the magnetron antenna to the heating chamber through the various openings.

6 Claims, 3 Drawing Sheets

HIGH FREQUENCY DISPERSING DEVICE IN A MICROWAVE OVEN

BACKGROUND OF THE INVENTION

The present invention relates to a high frequency dispersing device in a microwave oven which allows food to be heated by a direct heating method without using a turn table, or stirring fan, by dispersing naturally and by guiding high frequency energy which is generated from the magnetron using a waveguide and an upper plate in the heating chamber.

Considering the heating configuration of the conventional microwave oven, generally, the high frequency output energy which is generated from the magnetron and led to the waveguide may be dispersed with a stirring fan which is disposed at an upper part of the oven, and a turn table which may be rotated by a driving motor, which is arranged on the bottom surface in the heating chamber. The food to be cooked is placed on the turn table and heated by turning the turn table at a desired revolution speed. However, because the driving motor must be mounted for rotating the turn table and the stirring fan should be arranged for preventing the heat concentration of the high frequency energy, there are many disadvantages in that the number of necessary components may be increased for the reasons described above and, therefore, the manufacturing cost becomes expensive and the volume of the microwave oven body is increased.

SUMMARY OF THE INVENTION

Therefore, it is an object of the present invention to solve the foregoing problems by providing a microwave oven wherein the stirring fan which disperses the high frequency energy and the turn table which rotates the food to be cooked are eliminated and the dispersing of the high frequency is achieved by natural dispersing using a waveguide and the upper plate of the heating chamber so that the food to be cooked may be heated with a direct heating method. Therefore, not only the manufacturing cost may be decreased by decreasing the number and volume of the necessary parts, but also, the volume of the microwave oven body itself may be minimized.

More particularly, the waveguide which guides and leads the high frequency energy generated from the magnetron comprises a stage type including a stub on an upper plate thereof which protrudes upwardly above an antenna of the magnetron to a desired height. A conical protrusion protrudes downwardly at about the middle of the upper plate of the waveguide above the heat chamber. An elevated portion is formed on the upper plate of the heating chamber in which several openings, having different widths from each other, are formed longitudinally and latitudinally at a desired distance from the antenna of the magnetron. Based on this configuration, the high frequency energy which is generated from the magnetron is led and guided by the waveguide and the configuration of the base plate and is dispersed into the heating chamber such that the food to be cooked is heated by a direct heating method without a stirring fan or turn table. Thus, by the present invention, a high frequency dispersing device in a microwave oven wherein the number of components and the volume of the microwave oven are minimized is provided.

DETAILED DESCRIPTION OF THE PREFERRED EMBODIMENTS

Figure 1:
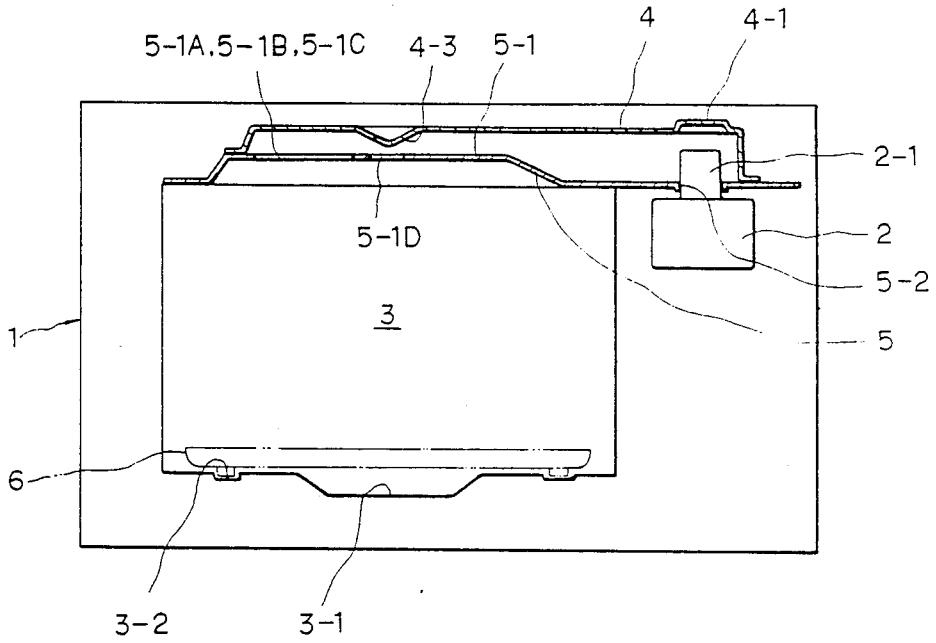
FIG. 1 is a schematic diagram of a microwave oven showing the high frequency dispersing device according to the present invention.
Figure 2:
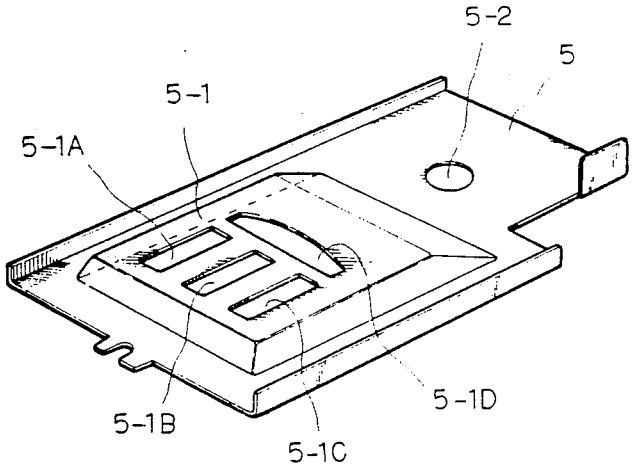
FIG. 2 is a perspective view of a base plate applied with the high frequency dispersing device according to the present invention.
Figure 3:
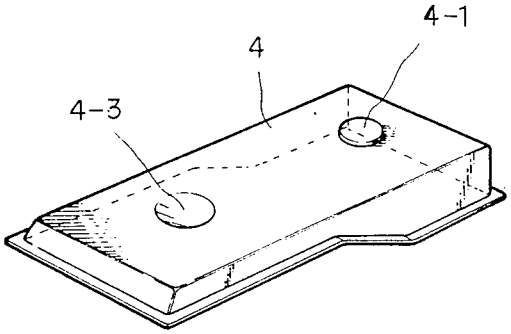
FIG. 3 is a perspective view of the waveguide applied with the high frequency dispersing device according to the present invention.
Figure 4:
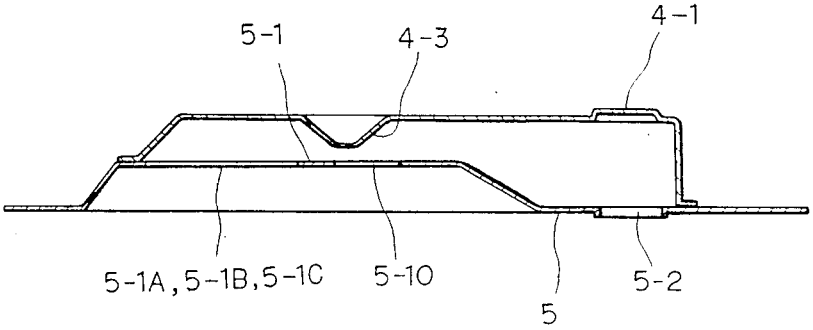
FIG. 4 is a longitudinal and sectional view of the high frequency dispersing device which is partially magnified in accordance with the present invention.
Figure 5:
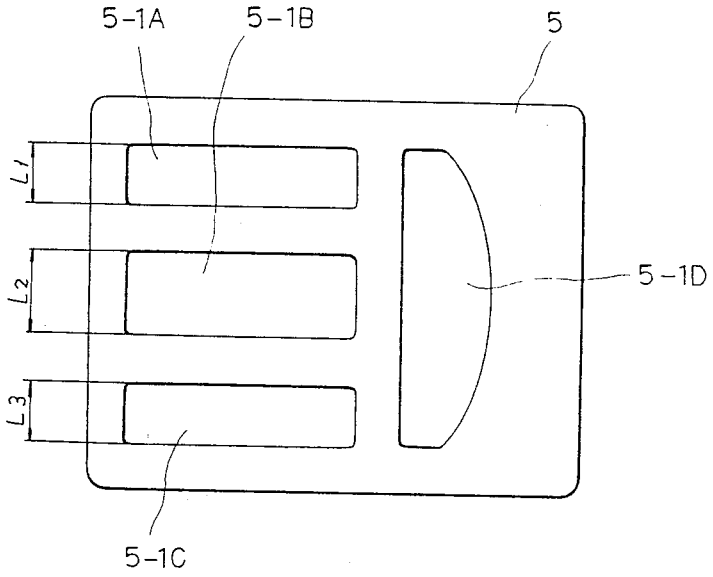
FIG. 5 is a top view of the base plate illustrating openings therein according to the present invention.

According to the present invention, as shown in FIG. 1, in an electronic microwave oven, the magnetron (2) is mounted at a side portion of the body (1) of the electronic oven, the high frequency energy which is oscillated and radiated from the antenna (2-1) is dispersed into the heating chamber (3) through the waveguide (4) so that the food to be cooked is heated. An insert hole (5-2) is provided in the base plate (5) for allowing the antenna (2-1) to protrude therethrough. The waveguide (4) which guides the high frequency energy into the heating chamber comprises a stage type, as shown in FIG. 3 and FIG. 4. A stub (4-1), which has a predetermined height, protrudes upwardly from the upper plate of the waveguide (4) just above the antenna (2-1). A conically shaped protrusion (4-3) is formed integrally at substantially the middle portion of the upper plate pointing toward the heating chamber (3). The elevated surface portion (5-1) is formed to recess up into the base plate (5). Disposed on the elevated surface portion (5-1) are a plurality of latitudinal openings (5-1A), (5-1B) and (5-1C) which have different widths (1-1, 1-2 and 1-3) from each other and a longitudinal opening (5-1D). These openings are disposed at a desired distance from the antenna (2-1), respectively. The latitudinal openings of (5-1A), (5-1B) and (5-1C) feed the waves of a longitudinal mode and the longitudinal opening (5-1D) feeds the waves of a latitudinal mode when the power source is excited.

An actual manufacturing example of the above waveguide (4) and the base plate (5) are explained in detail as follows. The width and the length of the waveguide, which is made to transfer effectively the microwave energy, i.e. the high frequency energy, by forming an empty cavity in order to decrease resistance loss and to prevent radiation loss in the transmission line, are respectively chosen to be 98 mm. and 2λg, where a wave length in the waveguide may be represented by:

$$\lambda g = \frac{\lambda}{\sqrt{1 - \left(\frac{\lambda}{2a}\right)^2}} = 156.816$$

Further, the distance from the magnetron antenna (2-1) to the starting point of each opening (5-1A), (5-1B), (5-1C), (5-1D) of the base plate (5) may be, for example, $\frac{3}{4}\lambda g = 117.6$, the width of the heating chamber may be, for example, $W = 3/2\ \lambda g = 235.2$ and the propagation coefficient may be represented by $B = 2\lambda/\lambda g$.

The local heating phenomenon is minimized by dispersing the high frequency energy into the chamber which is further dispersed by the concave portion (3-1) which is formed on the bottom of the heating chamber (3) and which varies in depth along the surface thereof. Reference numeral (3-2) represents insert holes for supporting a turn table (6).

Figure 6:
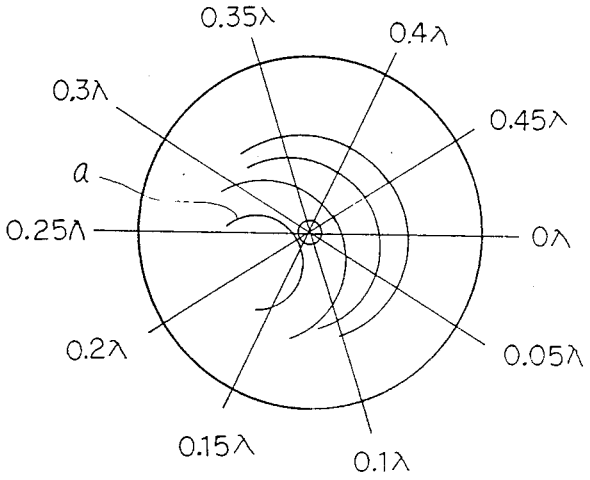
FIG. 6 is a distribution chart of the high frequency output energy which illustrates the state of high frequency energy dispersing by the high frequency dispersing device according to the present invention.

FIG. 6 illustrates a Rieke diagram showing the distributing state of the load impedance output according to the present invention. It will be seen that the outputs are widely distributed without utilizing a stirring fan.

In order to obtain the maximum output, it is preferred to locate the voltage standing wave ratio between 2 and 3 on the 0.3λ line of the Rieke diagram.

The frequency range without the turn table (6), shown in FIG. 1, in the present invention may be 2450 MHz to 2480 MHz, and moving from 0λ toward the distribution on the Rieke diagram, the varying value may be 0.05λ to 0.25λ.

When the turn table (6) does not exist, the varying value of the wave length (λ) may be 0.1λ to 0.34λ, when the load is 500 c.c or 1,000 c.c. The extent of the varying value of the frequency may be 2450 MHz to 2480 MHz, 2440 MHz–2480 MHz and 0.04λ to 0.23λ, 0.03λ to 0.25λ, respectively.

Further, the varying of the distributing direction of the Rieke diagram, regardless of the load, following the frequency increases, may be represented by $\lambda = c/f$, wherein c is the transmission velocity of light and f is the frequency. Therefore, the wave length will be decreased in accordance with frequency increases and the constant will become larger to compensate the value of the wave length.

The effect of the present invention, which is structured as described above, will be explained as follows. According to the present invention, by dispersing and guiding the high frequency energy using the structural configuration of the base plate (5), the elevated surface portion (5-1D), the conical protrusion (4-3) and the stub (4-1) of the waveguide (4), as opposed to the conventional heating method which utilizes a stirring fan and a turn table, the present invention allows food to be cooked using a direct heating method. Further, the number of components in the oven and the structural volume thereof may be decreased, such that the manufacturing cost may be decreased and the volume of the microwave oven will be minimized.

What is claimed is:

1. A high frequency dispersing device in a microwave oven having a bottom surface of a heating chamber comprising:
   - a concave portion disposed at said bottom surface;
   - a magnetron having an antenna;
   - a waveguide having a base plate disposed above the heating chamber, an elevated surface plate which rises upwardly from said base plate and an upper plate connected to said base plate;
   - said waveguide including:
   - a cavity portion which guides high frequency energy generated by said magnetron into said heating chamber;
   - a stub portion disposed on said upper plate above said magnetron antenna which protrudes upwardly to a predetermined height; and
   - a conically shaped protrusion portion disposed on said upper plate which protrudes downwardly toward said heating chamber; and
   - said elevated surface plate including several openings having different widths and shapes which are located at a predetermined distance from the magnetron antenna.

2. A high frequency dispersing device in a microwave oven according to claim 1, wherein said cavity is encased by said upper plate and said base plate, said cavity being located above said heating chamber.

3. A high frequency dispersing device in a microwave oven according to claim 1, wherein said stub portion protrudes upwardly in the form of a flat cylindrical dome.

4. A high frequency dispersing device in a microwave oven according to claim 1, wherein said conically shaped protrusion portion is disposed above substantially the center of said heating chamber and the center of one of said openings in said elevated surface plate.

5. A high frequency dispersing device in a microwave oven according to claim 1, wherein said elevated surface plate is elevated upwardly to form a two stage cavity.

6. A high frequency dispersing device in a microwave over according to claim 1, wherein said several opeings communicate with said heating chamber and include three openings located at a first distance from said magnetron antenna, said openings having major axes that are parallel to each other and extend longitudinally away from said magnetron antenna and a fourth opening located at a second distance from said magnetron antenna shorter than said first distance, said fourth opening having a major axis which extends in a direction that is perpendicular to the axes of said three openings.

* * * * *